US008850667B2

(12) United States Patent
Casubolo

(10) Patent No.: US 8,850,667 B2
(45) Date of Patent: Oct. 7, 2014

(54) GARMENT FASTENING SYSTEMS

(75) Inventor: Patrizia Angela Casubolo, Verdun, CA (US)

(73) Assignee: Patrizia Angela Casubolo, Verdun (CA)

( * ) Notice: Subject to any disclaimer, the term of this patent is extended or adjusted under 35 U.S.C. 154(b) by 272 days.

(21) Appl. No.: 13/332,504

(22) Filed: Dec. 21, 2011

(65) Prior Publication Data

US 2012/0192383 A1 Aug. 2, 2012

Related U.S. Application Data

(60) Provisional application No. 61/437,769, filed on Jan. 31, 2011.

(51) Int. Cl.

| | |
|---|---|
| ***A44C 11/02*** | (2006.01) |
| ***A44B 1/00*** | (2006.01) |
| ***A44B 1/18*** | (2006.01) |
| ***A41F 1/02*** | (2006.01) |
| *A44B 5/00* | (2006.01) |

(52) U.S. Cl.

CPC ... *A41F 1/02* (2013.01); *A44B 1/18* (2013.01); *A44B 5/00* (2013.01)

USPC ..... 24/114.8; 24/102 E; 24/114.7; 24/300

(58) Field of Classification Search

CPC ..... A41F 1/02; A44B 1/18; A44B 5/00

USPC ..... 24/104, 114.7, 114.8, 102 E, 300

See application file for complete search history.

(56) References Cited

U.S. PATENT DOCUMENTS 440,371 A * 11/1890 Schloss ..... 24/114.8
450,510 A 4/1891 Heuser (Continued)

FOREIGN PATENT DOCUMENTS

CA 1044443 12/1978
CA 2052131 5/1992

(Continued)

OTHER PUBLICATIONS

English Abstract of DE4112611, published on Oct. 22, 1992.

(Continued)

*Primary Examiner* — Robert J Sandy
*Assistant Examiner* — Louis Mercado
(74) *Attorney, Agent, or Firm* — Bereskin & Parr LLP/S.E.N.C.R.L., s.r.l.

(57) ABSTRACT

A garment fastening system having a button member adapted to be inserted into a buttonhole of a garment. The button member has a front wall, a rear wall and a side wall disposed therebetween. The button member defines an aperture that is extending from a portion of the rear wall and a portion of the side wall, and an internal chamber in communication with the aperture. The garment system also has a resilient member extending, through the aperture and having two opposite ends that are connected to the internal chamber thereby defining a loop at least partially extending outside the button member and adapted to receive a button of the garment. The aperture is dimensioned for allowing movement of the resilient member. The garment fastening system can be used for providing elasticity to a garment by simply connecting it to existing button and buttonhole.

18 Claims, 3 Drawing Sheets

(56) References Cited

U.S. PATENT DOCUMENTS

| | | | | | |
|---|---|---|---|---|---|
| 609,495 | A | | 8/1898 | Brooks | |
| 617,074 | A | * | 1/1899 | Blumenthal | 24/660 |
| 1,240,857 | A | | 9/1917 | Kinion | |
| 1,814,760 | A | | 7/1931 | Miller, Jr. | |
| 1,963,004 | A | | 6/1934 | Tucker | |
| 1,982,527 | A | | 11/1934 | Manekin | |
| 2,010,345 | A | | 8/1935 | Brewster | |
| 2,161,506 | A | * | 6/1939 | De Caracena | 63/26 |
| 2,291,766 | A | | 8/1942 | Sherwin | |
| 2,345,764 | A | | 4/1944 | May | |
| 2,425,091 | A | | 8/1947 | Fisch | |
| 2,564,008 | A | | 8/1951 | Holt | |
| 2,893,012 | A | | 7/1959 | Kahn | |
| 2,899,731 | A | | 8/1959 | Maxim | |
| 2,983,006 | A | | 5/1961 | Schafer | |
| 2,996,723 | A | | 8/1961 | Ainslie | |
| 3,030,630 | A | | 4/1962 | Kattermann | |
| 3,112,491 | A | | 12/1963 | Cleveland | |
| 3,142,843 | A | | 8/1964 | Berger | |
| 3,170,209 | A | | 2/1965 | Parry | |
| 3,303,543 | A | | 2/1967 | La Rue et al. | |
| 3,828,365 | A | | 8/1974 | Berger | |
| 4,043,006 | A | * | 8/1977 | Williams et al. | 24/114.8 |
| RE30,701 | E | * | 8/1981 | Williams et al. | 24/114.8 |
| 4,648,137 | A | | 3/1987 | Cooper | |
| 4,937,884 | A | | 7/1990 | Sherman | |
| 5,274,853 | A | | 1/1994 | Millican | |
| D350,028 | S | | 8/1994 | Apps | |
| 5,692,240 | A | | 12/1997 | Steele | |
| 5,704,933 | A | | 1/1998 | Fell et al. | |
| D393,416 | S | | 4/1998 | Tisbo | |
| D409,888 | S | | 5/1999 | So | |
| 6,070,434 | A | | 6/2000 | Traver | |
| 6,081,926 | A | | 7/2000 | Krause et al. | |
| 6,089,422 | A | | 7/2000 | Gibson | |
| 6,389,659 | B1 | * | 5/2002 | Jacobs | 24/573.09 |
| 6,668,386 | B2 | | 12/2003 | Vidal | |
| 6,874,164 | B2 | | 4/2005 | Droppo et al. | |
| 7,409,730 | B2 | | 8/2008 | Boos | |
| 2004/0181845 | A1 | | 9/2004 | Droppo et al. | |
| 2005/0022287 | A1 | | 2/2005 | Neff et al. | |
| 2005/0125876 | A1 | | 6/2005 | Kato | |
| 2005/0172379 | A1 | | 8/2005 | Bush et al. | |
| 2005/0210561 | A1 | | 9/2005 | Robinson | |
| 2005/0251891 | A1 | | 11/2005 | Keeter | |
| 2005/0278826 | A1 | | 12/2005 | Kato | |
| 2006/0048267 | A1 | | 3/2006 | Keeter | |
| 2008/0040833 | A1 | | 2/2008 | Kato | |
| 2008/0040903 | A1 | | 2/2008 | Dedo | |
| 2012/0005862 | A1 | * | 1/2012 | Severyn | 24/102 SL |

FOREIGN PATENT DOCUMENTS

| | | |
|---|---|---|
| CA | 2138369 | 12/1993 |
| CA | 2182626 | 2/1998 |
| CA | 2299924 | 9/2001 |
| CA | 2320398 | 9/2001 |
| CA | 2398593 | 2/2003 |
| CA | 2455784 | 2/2003 |
| CA | 2433257 | 9/2004 |
| CA | 2486749 | 5/2005 |
| CA | 2510374 | 12/2005 |
| CA | 2594147 | 2/2008 |
| EP | 169761 | 1/1986 |
| GB | 189809102 | 2/1899 |
| GB | 480001 | 2/1938 |
| GB | 497186 | 12/1938 |
| GB | 699143 | 10/1953 |
| GB | 2415357 | 12/2005 |
| GB | 2458284 | 9/2009 |
| WO | 2004098342 | 11/2004 |
| WO | 2006008778 | 1/2006 |

OTHER PUBLICATIONS

Figures 1 to 5 of AT188122, published on Dec. 27, 1956.

Figures 1 to 9 of FR2304300, published on Oct. 15, 1976.

Comfort-Fit collar, [online]. Retrieved from the Internet <URL: http://my.opera.com/usability/blog/show.dml/497318>, Jan. 4, 2010.

Button Extenders. As Seen on TV Guys [online]. Retrieved from the Internet <URL: http://asseenontvguys.com/index.asp?PageAction=VIEWPROD&ProdID=717>, Jan. 4, 2010.

Cuff and Collar Extender. Assistireland.le [online]. Retrieved from the Internet <URL: http://www.assistireland.ie/eng/Products_Directory/Clothing/Dressing_Devices/Buttoning_Aids/Cuff_and_Collar_Extender.html>, Jan. 4, 2010.

Button Extenders. Colonial Medical Assisted Devices [online]. Retrieved from the Internet <URL: http://www.colonialmedical.com/catalog/Button-Extenders-Set-of-3-p-21279.html>, Jan. 4, 2010.

* cited by examiner

GARMENT FASTENING SYSTEMS

CROSS-REFERENCE TO RELATED APPLICATION

The present application claims priority from U.S. provisional application No. 61/437,769 filed on Jan. 31, 2011, which is hereby incorporated by reference in its entirety.

FIELD OF THE DISCLOSURE

The present disclosure relates to the field of clothes and garments. More particularly, it relates to garment fastening systems.

BACKGROUND OF THE DISCLOSURE

It is a common realization that regular clothes and garments are normally created in definite sizes and shapes that do not fit every body types. Indeed, the morphology of the human body often tends to fall in between those definite sizes and shapes, which thus forces people to buy larger sizes and have clothes tailored. Indeed, unless a person of a larger size buys a tailored shirt, he often has to buy one or two sizes beyond its size so that the collar is comfortable and connected. As a result, the sleeves have to be shortened, but regularly, after two or more washes, the fabric tends to shrink. Such a situation is especially problematic for larger or obese persons as well as for athletes, which cannot find clothes that fit their proportions. For example, athletes often have difficulties wearing shirts or other pieces of clothing because the collar is frequently too tight for their muscular neck, which causes discomfort and suffocation. Also, the cuffs of shirts usually have two buttons to adjust to the diameter of the wrist and allow the necessary space for a wristwatch on both hands: however, those with a larger or more muscular wrist and arm are often in a situation where the shirt is stuck at the wrist and cannot follow the movement of the person. For example, if a person lifts its upper arm (typical position in a metro or bus), the shirt or clothing will be stuck at the wrist and will not scroll down, which can cause tearing of the shirt and/or irritation to the person's skin.

Other potentially problematic situations include the ones where, even if the garment initially fits the body of the person, the person's action or position causes the garment or clothing to become uncomfortable or even rip because the clothing material cannot expend as needed. For example, after a good lunch or during a stressful situation, the neck can start to swell because of higher blood circulation, which therefore forces the person to loosen his collar and tie because since it becomes too tight for comfort. Similarly, after an intense physical action, the person's body can swell, which can therefore provoke tearing of the garment because of its lack of flexibility. Also, some actions can be limited because of the lack of elasticity of the garment, such several body extensions and movements.

SUMMARY OF THE DISCLOSURE

According to one aspect, there is provided a garment fastening system comprising:

A garment fastening system comprising:

a button member adapted to be inserted into a buttonhole of a garment, the button member comprising a pair of opposed walls and a side wall disposed therebetween, the button member defining an aperture extending from a portion of one of the opposed walls and a portion of the side wall, the button member consisting essentially of a single piece; and a resilient member extending through the aperture and connected to the button member, the resilient member being adapted to be connected to a button of the garment, the resilient member having at least a portion connected to an internal portion of the button member and having at least a portion extending outside the button member.

According to another aspect, there is provided a garment fastening system comprising:

A garment fastening system comprising:

a button member adapted to be inserted into a buttonhole of a garment, the button member comprising a front wall, a rear wall and a side wall disposed therebetween, the button member defining an aperture extending from a portion of the rear wall and a portion of the side wall, and an internal chamber in communication with the aperture; and a resilient member extending through the aperture and having two opposite ends that are connected to the internal chamber thereby defining a loop at least partially extending outside the button member and adapted to receive a button of the garment, the aperture being dimensioned for allowing movement of the resilient member.

According to another aspect, there is provided a garment fastening system comprising:

A garment fastening system comprising:

a button member adapted to be inserted into a buttonhole of a garment, the button member comprising a front wall, a rear wall and a side wall disposed therebetween, the button member having a single aperture defined on the rear wall and a single internal chamber in communication with the aperture, the button member consisting essentially of a single piece; and a resilient member extending through the aperture and having two opposite ends that are connected to the internal chamber thereby defining a loop at least partially extending outside the button member and adapted to receive a button of the garment, the rear wall being convex for facilitating a pivotal movement of the resilient member.

According to another aspect, there is provided a garment fastening system comprising:

A garment fastening system comprising:

a button member adapted to be inserted into a buttonhole of a garment, the button member comprising a pair of opposed walls and a side wall disposed therebetween, the button member defining an aperture that is extending from a portion of one of the opposed walls and a portion of the side wall; and a resilient member connected to the button member and adapted to be connected to a button of the garment, the resilient member being connected to an internal portion of the button member and extending outside the button member through the aperture.

It was found that such garment fastening systems are effective for providing a required level of flexibility and comfort to a person without altering the external look of a garment and/or the person. Such systems allow to have an adjustable internal circumference defined by the garment when being in a fastened position. Indeed, such a garment fastening system can be used wherever flexibility is needed, and can still be substantially invisible to the eye and more particularly when the resilient member is a rest position and/or when the person wears for example a shirt having a collar with such a system as well as a tie. It was also found that such fastening garment systems can be efficient to provide flexibility to the clothes or garments and that can be applied manually by the person wearing the clothing or garment. Such garment fastening systems can be used with various types of shirts or sweaters.

In fact, they be applied to various types and sizes of garments so has to increase an internal circumference defined by the garment when being in a fastened position. These garment fastening systems provides a simple and cheap solution to provide more flexibility and more comfort to a user. They can also be used to easily and rapidly modify the size of a collar, waist or a cuff without having recourse to a seamstress or a couturier. For example, a user can thus easily modify the size of a collar, a waist or a cuff even if this user does not have the specific skills of a couturier or a seamstress.

According to another aspect, there is provided a method for manufacturing a garment fastening system as defined in the present disclosure, the method comprising inserting the resilient member into the internal portion;

pivoting the resilient member into the first position at which the resilient member abuts the portion of the one of the opposite walls;

inserting glue into the internal portion so as to glue the resilient member together with the internal portion;

wherein insertion of the glue can be made at any time during the method.

According to another aspect, there is provided a method for manufacturing a garment fastening system as defined in the present disclosure, the method comprising inserting the resilient member into the internal chamber;

pivoting the resilient member into the rear position at which the resilient member abuts the portion of the rear wall; and inserting glue into the internal portion so as to glue the resilient member together with the internal portion, wherein insertion of the glue can be made at any time during the method.

According to another aspect, there is provided a method for manufacturing a garment fastening system as defined in the present disclosure, the method comprising:

inserting the resilient member into the internal chamber;

pivoting the resilient member; and inserting glue into the internal portion so as to glue the resilient member together with the internal portion, wherein insertion of the glue can be made at any time during the method.

BRIEF DESCRIPTION OF THE DRAWINGS

In the appended drawings which represent various examples.

DETAILED DESCRIPTION OF THE DISCLOSURE

Figure 1:
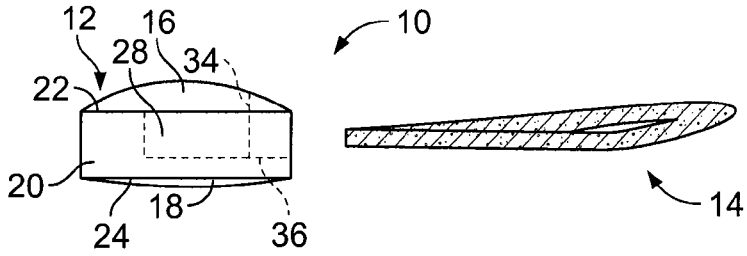
FIG. 1 is an exploded side view representing an example of a garment fastening system according to the present disclosure, in which the button member and the resilient member have been separated from one another for illustrative purposes.

The following examples are presented in a non-limitative manner.

For example, the button member can have general shape of a disc. For example, one of the opposed walls can be convex. For example, the button member can comprise a peripheral edge disposed between the one of the opposed walls and the side wall, the portion of the one of the opposed walls and the portion of side wall being adjacent to the peripheral edge.

For example, the resilient member can be an elastic member.

For example, the aperture can be dimensioned for allowing a pivotal movement towards the side wall and towards the one of the opposite wall. For example, the aperture can be dimensioned for allowing a pivotal movement of the resilient member from a first position whereat the resilient member abuts the portion of the one of the opposite walls to a second position whereat the resilient member abuts the portion of the side wall.

For example, the systems of the present disclosure can be provided with a pair of opposed walls comprising a front wall and a rear wall, the aperture being defined between a portion of the rear wall and a portion of the side wall. The front wall can be substantially flat. The aperture can have a first portion defined on the one of the opposed walls and a second portion defined on the side wall, the first portion having a greater surface area than a surface area of the second portion.

For example, the aperture can have a surface area and wherein more than 60%, 70 or 80% of the surface area is defined on the one of the opposed walls.

For example, a diameter of the internal portion or chamber can be about 2.05 to about 2.55 or about 2.1 to about 2.5 times greater than a diameter of the resilient member.

For example, the button member can have a general disc shape and the general disc shape defines a single circumference.

For example, the internal portion can be an internal chamber defined inside the button member, the internal chamber being in communication with the aperture. The resilient member can have two opposite ends connected to the internal portion thereby defining a loop adapted to receive a button of the garment. The resilient member can have an elastic having a general cylindrical shape.

For example, the aperture can be dimensioned for allowing a pivotal movement towards the side wall and towards the rear wall.

For example, the aperture can be dimensioned for allowing a pivotal movement of the resilient member from a rear position whereat the resilient member abuts the portion of the rear wall to a front position whereat the resilient member abuts the portion of the side wall.

For example, the aperture can have a first portion defined on the rear wall and a second portion defined on the side wall, the first portion having a greater surface area than a surface area of the second portion.

For example, the button member can be a single piece button member. The button member can be made of a polymeric material.

For example, the glue can be inserted after pivoting the resilient member into the first position (for example rear position).

For example, glue can be applied when the resilient member is at the rear position and at least a portion of the glue can be applied on a portion of the resilient member that is distant from the front wall when the resilient member is in the first position (for example rear position) and that abuts the front wall when the resilient member is at the second position (for example front position). The resilient member can then be pivoted into the second position (for example front position).

Reference will now be made to the non-limitative examples illustrated in the figures.

As it can be seen from FIGS. 1 to 5, the garment fastening system comprise a button member 12 and a resilient member 14. The button member 12 comprises two opposed walls (for example, a rear wall 16 and a front wall 18). The button member 12 also comprises a side wall 20 as well as two peripheral edges disposed between the side wall and the opposed walls. For example, the peripheral edge can be edges such as 22 (rear peripheral edge) and 24 (front peripheral edge). The button member 12 is also provided with an aperture 26 that is in communication with an internal chamber 28. The aperture 26 and the internal chamber 28 are adapted to receive opposed ends 30 of the resilient member 14. For example, the aperture 26 and the internal chamber 28 can be dimensioned so as to optionally tightly receive or engage the resilient member 14. The resilient member 14 can be connected to the button member 12 by various manners such as by mean of an adhesive, sewed, fused, etc. In fact, the opposed ends 30 can be glued into the internal chamber 28. For example, the diameter of the internal chamber 28 can be about 2.05 to about 2.55 or about 2.1 to about 2.5 times greater than the diameter of the resilient member 14.

As shown in FIGS. 1 to 5, the button member 12 can have a disc shape. It can also have another shape such a parallelepiped, a cylindrical or elongated shape, a triangular shape etc. For example, at least one of the opposed was can be convex (for example, the rear wall 16). It was found that such a convex wall facilitate insertion of the button member 12 into a buttonhole. Moreover, at least one of the opposed walls can be substantially flat (for example, the front wall 18). For example, the button member can have the general shape of a disc.

Figure 5:
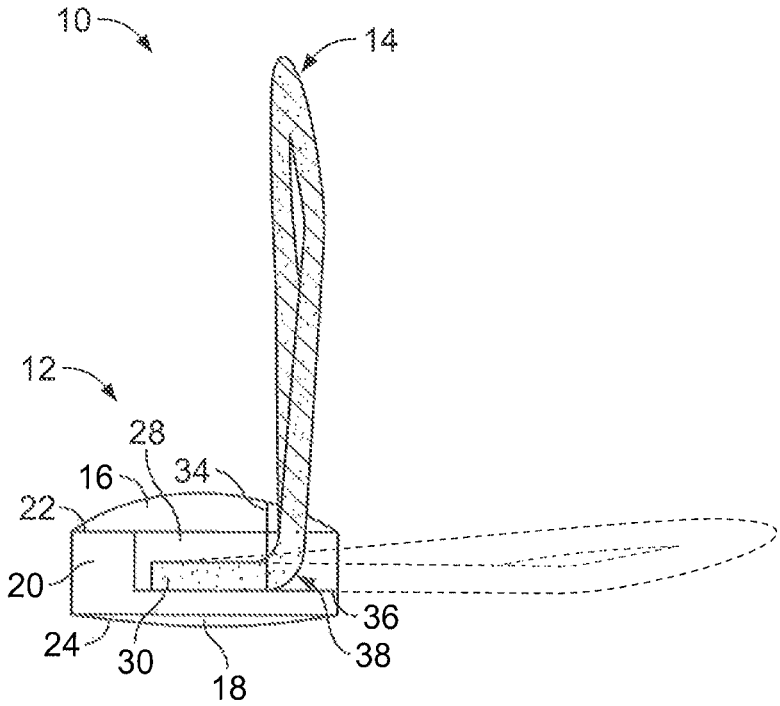
FIG. 5 is a side view of the garment fastening system of FIG. 1 in which the resilient member has been inserted in the button member, the resilient member is shown in a rear position (or raised position) and the dotted lines represent the resilient member in a front position.

As it can be seen from FIG. 5, when the resilient member 14 is connected to the button member 12 (for example when the opposed ends 30 of the resilient 14 are inserted into the internal chamber 28, the resilient member can pivot from a rear position (full lines) to a front position (see the doted lines). In fact, when the resilient member 14 is in the rear position, the latter abuts against a portion 34 of the rear wall 16. Moreover, when the resilient member 14 is in the front position, the latter abuts against a portion of the front wall 18.

Figure 2:
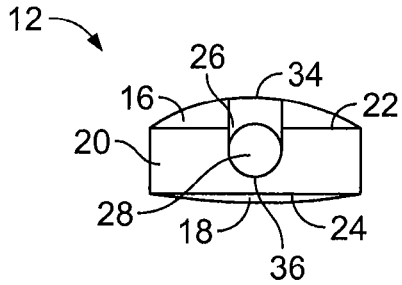
FIG. 2 is a front view of the garment fastening system of FIG. 1, in which the resilient member has been omitted for illustrative purposes.
Figure 3:
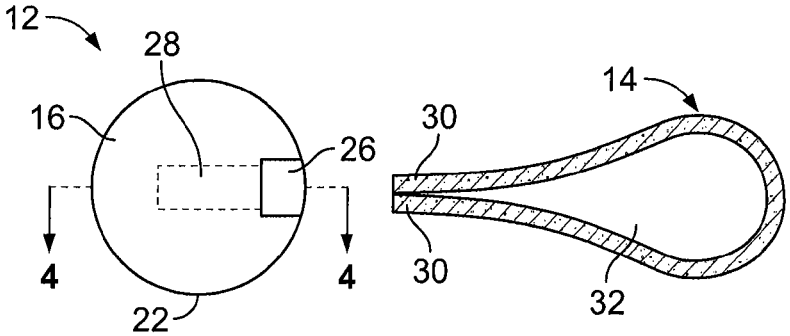
FIG. 3 is a top view of the garment fastening system of FIG. 1.
Figure 4:
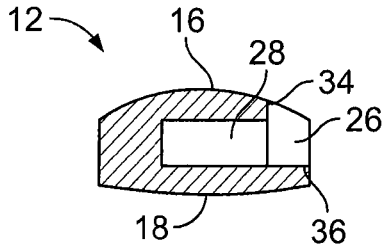
FIG. 4 is cross-section view of the garment fastening system according of FIG. 1 taken along the lines 4-4, in which the resilient member has been omitted for illustrative purposes.

As it can be seen on FIG. 2, the aperture 26 extends from the rear wall 16 to the side wall 20. In fact, the aperture 26 thus defines a first surface area on the rear wall 16 and defines a second surface area on the side wall 20. For example, the first surface area can be greater than the second surface area. In other words, a major portion or a main portion of the aperture extends on the rear wall 16. For example, more than 60%, 70% or 80% of the aperture can be defined on one of the opposed walls, for example, on the rear wall 16.

A user would understand easily how to use the fastening garment of FIGS. 1 to 5. Even without taking a look to instructions that can be provided with the system shown in FIGS. 1 to 5, a user can easily figure out how it works.

The button member 12 can have a diameter that is similar to the general diameter of standard buttons on the market such as about 6 to about 15 mm or about 10 to about 12 mm.

The button member 12 can also have the same general dimensions than standard buttons. For example, the thickness can be about 2 to about 5 mm or about 2 to about 4 mm.

Thus, a user desirous of having more comfort and desirous of fastening his or her garment in a manner which is less rigid or less tight or in a more comfortable manner can simply introduce an existing button of his garment into a space 32 defined by the resilient member 14 (loop). The resilient member 14 can be made of various elastic or resilient materials such as polymers. The resilient member 14 can have various shapes such as a general cylindrical shape or a general parallelepiped shape, etc. The resilient member 14 can also be of various lengths in order to adjust the size of the space 32. Therefore, various sizes of fastening garment can be made either with respect to the size of the button member as well as with respect to the size (length of the resilient member) of the space 32.

Therefore, once an existing button of a garment is inserted into the space 32, the user simply has to introduce the button member 12 into an existing buttonhole of his or her garment, thereby fastening the garment by providing extra room for comfort that is provided by the fact that the resilient member 14 has some elasticity. In fact, the fastening garment system 10 allows for expanding, thereby avoiding uncomfortable situations to the user as previously described. In brief, some elasticity and flexibility is provided to the garment.

It has been found that by having a design that allows a pivotal movement of the resilient member 14 in a manner such as illustrated in FIG. 5, it was possible to avoid to face a situation into which the button member 12 is tilted or is extending at a visual odd angle with respect to the garment i.e. an angle that is different than the general parallel relation between the top wall of a button and a garment. In fact, it was found that by adapting the button member in such a manner to provide such a pivotal movement of the resilient member 14, it was possible to avoid the situations in which the button member is tilted because some forces are applied on it by means of the resilient member 14 when the garment fastening system 10 is in a stretched mode or position. In fact, it was observed that certain garment fastening systems that did not have such a design and that were tested by the inventors had tendency to tilt and/or to be dislodged (unfasten) from the existing buttonhole of the garment when a force was exerted i.e. when some tension was applied by the user for example, when moving or making certain movements (stretching the garment) the button member of the prior art that was already tilted or inclined had tendency to unfasten from the buttonhole. Therefore, the design, as shown in FIGS. 1 to 5, allows for avoiding a situation in which the fastening garment system 10 will be involuntarily unfastened and as well as a situation in which the button member 12 will extend, into the existing buttonhole of the garment, at an odd angle or an angle in which the button member is inclined as compared to the general state of a button in a buttonhole of a garment i.e. the front wall of the button being substantially parallel to the garment and to the buttonhole.

For example, the button member 12 can be a single piece button member. This considerably simplifies the production process of such a fastening garment system. It can also lower the costs. The same also applies to the resilient member 14.

The garment fastening system 10 can be manufactured as follows. The resilient member 14 can be introduced into the internal chamber 28 and then, the resilient member can be pivoted into a first position whereat it abuts the portion 34 of the rear wall 16. Then, glue can be applied into the internal chamber 28 so as to glue or connect together the resilient member 14 and the button member 12 (for example chamber 28.) For example, it was observed that when the glue was applied when the resilient member 14 was standing in a rear position as shown in FIG. 5 (abutting against the portion 34 of the rear wall 16) and that a portion of the glue was applied on a portion 38, the obtained button member 12 had even less tendency to tilt or to extend at a visual odd angle with respect to the garment. Moreover, it was shown that when made according to such a method, the button member 12 had also less tendency to unfasten from the buttonhole. For example, when inserting the resilient member 14 into the button member 12, the latter can be disposed in such a manner that the wall 18 is substantially horizontally extending. For example, when the glue is inserted into the chamber or through the aperture 26, a portion of the glue can be applied on the portion 38 that does not contact or abut the wall 18 or the portion 36 when the resilient member is in the rear position (raised position). Then, the resilient member 14 can be brought back into or pivoted into the front position. When applying the glue, the wall 18 can also be substantially horizontally extending.

Figure 6:
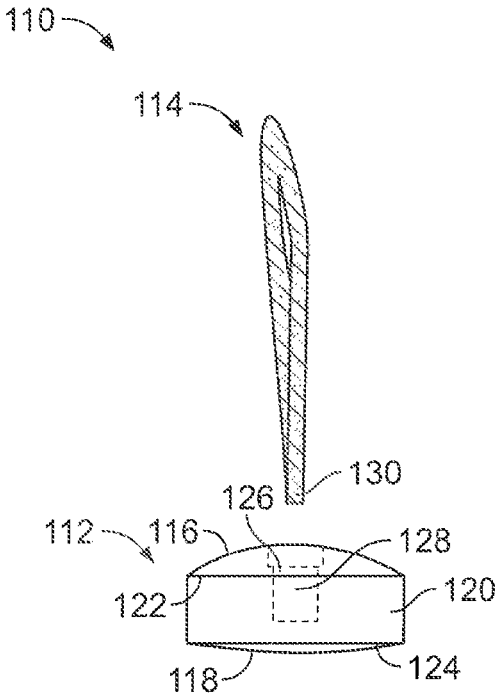
FIG. 6 is an exploded side view representing another example of a garment fastening system according to the present disclosure, in which the button member and the resilient member have been separated from one another for illustrative purposes.
Figure 7:
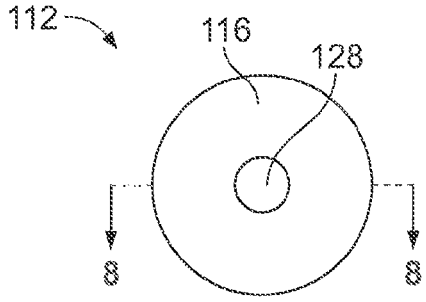
FIG. 7 is a top view of the garment fastening system of FIG. 6.
Figure 8:
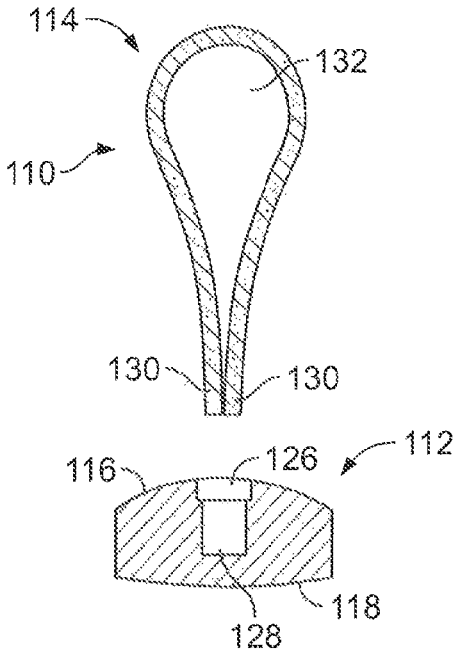
FIG. 8 is cross-section view of the garment fastening system according of FIG. 6 taken along the lines 8-8, in which the resilient member has been added for illustrative purposes.

As it can be seen in FIGS. 6 to 8, there is provided a variant of the garment fastening system shown in FIGS. 1 to 5.

FIGS. 6 to 8 show a garment fastening system 110 having a button member 112 and the resilient member 114. The button member 112 comprises two opposed walls (for example, a rear wall 116 and a front wall 118). The button member 112 also comprises a side wall 120 as well as two peripheral edges 122 (rear peripheral edge) and 124 (front peripheral edge). The button member 112 is also provided with a single aperture 126 that is in communication with an internal chamber 128. The chamber 128 and the aperture 126 are adapted to receive opposed ends 130 of the resilient member 114. The aperture 126 and the internal chamber 128 can be dimensioned so as to optionally tightly receive or engage the resilient member 114. The aperture 126 and the chamber 128 are disposed at the center of the button member 112. The resilient member 114 can be connected to the button member 112 by various manners as previously discussed for the garment fastening system 112. The resilient member defines a loop that generates the space 132 into which the existing button of a garment can be inserted.

The garment fastening system 110 can thus be used in a manner that is similar to the garment fastening system 10 previously described. It has been observed that due to the fact that the rear wall 116 is convex, it was possible to substantially eliminate (not in a manner as efficient as the system 10, but at a certain level) situations in which, when receiving an existing button at one end and inserted into a buttonhole at the other end, it extends at an odd angle or an angle in which the button member is inclined as compared to the general state of a button in a buttonhole of a garment i.e. the front wall of the button being substantially parallel to the garment and to the buttonhole. It was observed that such a convex wall allows the resilient member to pivot according to a certain angle that will substantially eliminate such undesirable situations.

The present disclosure has been described with regard to specific examples. The description was intended to help the understanding of the disclosure, rather than to limit its scope. It will be apparent to one skilled in the art that various modifications may be made to the disclosure without departing from the scope of the disclosure as described herein, and such modifications are intended to be covered by the present document.

The invention claimed is:

1. A garment fastening system comprising:

a button member adapted to be inserted into a buttonhole of a garment, said button member comprising a front wall, a rear wall and a side wall disposed therebetween, said button member defining an aperture that is extending from a portion of said rear wall and a portion of said side wall, and an internal chamber in communication with said aperture; and a resilient member extending through said aperture and having two opposite ends that are connected to said internal chamber thereby defining a loop at least partially extending outside said button member and adapted to receive a button of said garment, said aperture being dimensioned for allowing movement of said resilient member from a rear position whereat said resilient member abuts said portion of said rear wall without abutting said portion of said side wall; to a front position whereat said resilient member abuts said portion of said side wall without abutting said portion of said rear wall, said resilient member being glued into an internal portion of said button member or into said internal chamber.

2. The system of claim 1, wherein said aperture has a first portion defined on said rear wall and a second portion defined on said side wall, said first portion having a greater surface area than a surface area of said second portion.

3. The system of claim 1, wherein said aperture has a first portion defined on said rear wall and a second portion defined on said side wall, said first portion having a greater surface area than a surface area of said second portion.

4. The system of claim 1, wherein said aperture has a surface area and wherein more than 60% of said surface area is defined on said rear wall.

5. The system of claim 1, wherein said aperture has a surface area and wherein more than 80% of said surface area is defined on said rear wall.

6. The system of claim 1, wherein said button member has a general disc shape.

7. The system of claim 1, wherein said button member has a general disc shape.

8. The system of claim 1, wherein said front wall is substantially flat.

9. The system of claim 8, wherein said rear wall is convex.

10. The system of claim 1, wherein said rear wall is convex.

11. The system claim 1, wherein said resilient member is an elastic member.

12. The system of claim 1, wherein said button member consists essentially of a single piece.

13. The system of claim 1, wherein said resilient member is glued into said internal chamber.

14. The system of claim 13, wherein said aperture has a surface area and wherein more than 70% of said surface area is defined on said rear wall.

15. The system of claim 1, wherein a diameter of said internal chamber is about 2.1 to about 2.5 times greater than a diameter of said resilient member.

16. A method for manufacturing a garment fastening system as defined in claim 1, said method comprising:

inserting said resilient member into said internal chamber;

pivoting said resilient member into said rear position at which said resilient member abuts said portion of said rear wall;

inserting glue into said internal portion so as to glue said resilient member together with said internal portion, wherein insertion of said glue can be made at any time during said method.

17. The method of claim 16, wherein said glue is inserted after pivoting said resilient member into said rear position.

18. The method of claim 17, wherein glue is applied when said resilient member is at said rear position, at least a portion of said glue being applied on a portion of said resilient member that is distant from a portion of said front wall when said resilient member is in said rear position and that abuts said portion of said front wall when said resilient member is at said front position.

* * * * *